US006772600B2

(12) United States Patent
Hwang

(10) Patent No.: US 6,772,600 B2
(45) Date of Patent: Aug. 10, 2004

(54) MULTI-UNIT AIR CONDITIONER AND METHOD FOR CONTROLLING THE SAME

(75) Inventor: Il Nahm Hwang, Ansan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/459,506

(22) Filed: Jun. 12, 2003

(65) Prior Publication Data

US 2003/0230096 A1 Dec. 18, 2003

(30) Foreign Application Priority Data

Jun. 12, 2002 (KR) ..... P10-2002-0032901

(51) Int. Cl.[7] ..... F25B 13/00

(52) U.S. Cl. ..... 62/160; 62/196.1; 62/196.4; 62/199

(58) Field of Search ..... 62/160, 175, 196.4, 62/196.1, 122, 210, 324.1, 199, 200, 117

(56) References Cited

U.S. PATENT DOCUMENTS

2004/0035132 A1 * 2/2004 Park et al. ..... 62/324.1

FOREIGN PATENT DOCUMENTS

EP 0496505 7/1992
EP 0509619 10/1992
JP 401203850 A * 8/1989 ..... 62/196.1

* cited by examiner

*Primary Examiner*—Marc Norman
(74) *Attorney, Agent, or Firm*—Greenblum & Bernstein, P.L.C.

(57) ABSTRACT

Multi-unit air conditioner including an outdoor unit including a flow path control valve for controlling a flow path of refrigerant from a compressor, outdoor heat exchanger having one side in communication with the flow path control valve, a first bypass pipeline having one end connected to the first pipeline which makes the flow path control valve and the outdoor heat exchanger to be in communication, and the other end connected to the second pipeline connected to the other end of the outdoor heat exchanger, and a flow rate control valve provided on the first bypass pipeline for controlling a flow rate of the refrigerant passing through the first bypass pipeline, an indoor unit having an indoor heat exchanger and indoor electronic expansion valve installed in each of rooms, a distributor for selective distribution of the refrigerant received through one of two pipelines connected to the outdoor unit to the indoor units, and returning to the outdoor unit through the other one pipeline, and controlling means for measuring a gas/liquid mixing ratio of the refrigerant introduced into the distributor, the refrigerant having joined after respectively passing through the first bypass pipeline and the outdoor heat exchanger, for controlling an opening of the flow rate control valve, to control the mixing ratio.

21 Claims, 5 Drawing Sheets

MULTI-UNIT AIR CONDITIONER AND METHOD FOR CONTROLLING THE SAME

This application claims the benefit of the Korean Application No. P2002-32901 filed on Jun. 12, 2002, which is hereby incorporated by reference.

BACKGROUND OF THE INVENTION

1. Field of the Invention

The present invention relates to a multi-unit air conditioner, and more particularly, to a multi-unit air conditioner having an improved outdoor piping system and an improved refrigerant mixing ratio controlling system, and a method for controlling the same.

2. Background of the Related Art

In general, the air conditioner is an appliance for cooling or heating spaces, such as living spaces, restaurants, and offices. At present, for effective cooling or heating of a space partitioned into many rooms, it is a trend that there has been ceaseless development of multi-unit air conditioner. The multi-unit air conditioner is in general provided with one outdoor unit and a plurality of indoor units each connected to the outdoor unit and installed in a room, for cooling or heating the room while operating in one of cooling or heating mode.

However, the multi-unit air conditioner is operative only in one mode of cooling or heating uniformly even if some of the many rooms within the partitioned space require heating, and rest of the rooms require cooling, the multi-unit air conditioner has a limit in that the requirement can not be met, properly.

For an example, even in a building, there are rooms having a temperature difference depending on locations of the rooms or time of the day, such that while a north side room of the building requires heating, a south side room of the building requires cooling due to the sun light, which can not be dealt with a related art multi-unit air conditioner that is operative in a single mode.

Moreover, even though a building equipped with a computer room requires cooling not only in summer, but also in winter for resolving the problem of heat load of the computer related equipment, the related art multi-unit air conditioner can not deal with such a requirement, properly.

In conclusion, the requirement demands development of multi-unit air conditioner of concurrent cooling/heating type, for air conditioning rooms individually, i.e., the indoor unit installed in a room requiring heating is operable in a heating mode, and, at the same time, the indoor unit installed in a room requiring cooling is operable in a cooling mode.

SUMMARY OF THE INVENTION

Accordingly, the present invention is directed to a multi-unit air conditioner and a method for controlling the same that substantially obviates one or more of the problems due to limitations and disadvantages of the related art.

An object of the present invention is to provide a multi-unit air conditioner which cools and heats rooms individually suitable to individual room requirements, and has very simple outdoor unit system.

Another object of the present invention is to provided a method for controlling operation of a multi-unit air conditioner, in which a gas-liquid mixing ratio of refrigerant introduced into a gas-liquid separator is optimized in an operation of cooling all rooms and cooling a major number of rooms and heating a minor number of rooms, for improving an air conditioning efficiency.

Additional features and advantages of the invention will be set forth in the description which follows, and in part will be apparent to those having ordinary skill in the art upon examination of the following or may be learned from practice of the invention. The objectives and other advantages of the invention will be realized and attained by the structure particularly pointed out in the written description and claims hereof as well as the appended drawings.

To achieve these objects and other advantages and in accordance with the purpose of the present invention, as embodied and broadly described herein, the multi-unit air conditioner includes an outdoor unit including a flow path control valve for controlling a flow path of refrigerant from a compressor, outdoor heat exchanger having one side in communication with the flow path control valve, a first bypass pipeline having one end connected to the first pipeline which makes the flow path control valve and the outdoor heat exchanger to be in communication, and the other end connected to the second pipeline connected to the other end of the outdoor heat exchanger, and a flow rate control valve provided on the first bypass pipeline for controlling a flow rate of the refrigerant passing through the first bypass pipeline, an indoor unit having an indoor heat exchanger and indoor electronic expansion valve installed in each of rooms, a distributor for selective distribution of the refrigerant received through one of two pipelines connected to the outdoor unit to the indoor units, and returning to the outdoor unit through the other one pipeline, and controlling means for measuring a gas/liquid mixing ratio of the refrigerant introduced into the distributor, the refrigerant having joined after respectively passing through the first bypass pipeline and the outdoor heat exchanger, for controlling an opening of the flow rate control valve, to control the mixing ratio.

The operation mode includes a first operation mode for cooling all rooms, a second operation mode for heating all rooms, a third operation mode for cooling a major number of rooms and heating a minor number of rooms and a fourth operation mode for heating a major number of rooms and cooling a minor number of rooms.

The distributor is made to be in communication with the outdoor unit with a fourth pipeline having one end connected to the flow path control valve and a second pipeline having one end connected to the outdoor heat exchanger.

The flow control valve includes a first port in communication with an inlet of the compressor, a second port connected to the first pipeline, a third port having one end connected to the other end of the third pipeline connected to an outlet of the compressor, and a fourth port connected to one end of the fourth pipeline.

The flow path control valve makes the outlet of the compressor and the first pipeline in communication, and the third and fourth pipelines in communication in the first and third operation modes.

The flow path control valve makes the outlet of the compressor and the fourth pipeline in communication, and the first and third pipelines in communication in the second and fourth operation modes.

The indoor unit further includes an accumulator mounted on the third pipeline.

The controlling means includes a temperature sensor provided on the second pipeline for measuring a temperature of gas/liquid mixed refrigerant joined after respectively passing through the outdoor heat exchanger and the first bypass pipeline, and a microcomputer for comparing the refrigerant temperature measured by the temperature sensor and a preset refrigerant temperature, to detect the gas/liquid refrigerant mixing ratio, and controlling an opening of the flow rate control valve for making a detected mixing ratio to meet the preset mixing ratio required for a required operation mode.

The flow rate control valve is fully closed in the first, second, or fourth operation mode, and has the opening thereof controlled by the microcomputer in the third operation mode.

The outdoor unit further includes a first electronic expansion valve mounted on the second pipeline between the other end of the outdoor heat exchanger and the first bypass pipeline, and a first check valve mounted in parallel with the first electronic expansion valve for passing refrigerant flowing only from the outdoor heat exchanger toward the distributor.

The first electronic expansion valve is controlled such that the first electronic expansion valve is fully closed in the first or third operation mode, and expands the refrigerant flowing from a distributor side to an outdoor heat exchanger side in the second or fourth mode.

The distributor makes the gas refrigerant introduced thereto from the outdoor unit to flow toward indoor unit heat exchangers which are to heat the rooms, the liquid refrigerant introduced thereto from the outdoor unit toward electronic expansion valves of the indoor units which are to cool the rooms, and the refrigerant passed through the indoor units to flow to the outdoor unit again, wherein, in a case heating or cooling of the rooms are carried out individually, the refrigerant liquefied as the refrigerant passes through the indoor unit which is to heat the room is made to flow toward the electronic expansion valve of the indoor unit which is to cool the room before making the refrigerant to flow to the outdoor unit.

The distributor includes a gas-liquid separator connected to the second pipeline for separating gas/liquid mixed refrigerant received from the second pipeline into gas refrigerant and liquid refrigerant, a distribution piping system for guiding the refrigerant from the outdoor unit to the indoor units, and from the indoor units to the outdoor unit, and a valve unit on the distribution piping system for controlling flow of the refrigerant in the distribution piping system to be consistent with respective modes.

The distribution piping system includes a gas refrigerant pipeline connected to a gas port of the gas-liquid separator, a liquid refrigerant pipeline connected to a liquid port of the gas-liquid separator, liquid refrigerant branch pipelines branched from the liquid refrigerant pipeline and connected to the indoor expansion valves in the indoor units respectively, gas refrigerant branch pipelines branched from the gas refrigerant pipeline and connected to the indoor heat exchangers, respectively, and connection pipelines respectively branched from the gas refrigerant branch pipelines and connected to the fourth pipeline.

The distributor further includes a second bypass pipeline having one end connected to the liquid refrigerant pipeline adjacent to the liquid port, and the other end connected to the gas refrigerant pipeline adjacent to the gas port, a second check valve on the liquid refrigerant pipeline between the one end of the bypass pipeline and the liquid port, for making the refrigerant to flow from a liquid port side toward the liquid refrigerant branch pipeline side, and a second electronic expansion valve on the second bypass pipeline.

The second electronic expansion valve is controlled such that the second electronic expansion valve is closed fully in the first or third operation mode, and causes the refrigerant to expand in the second or fourth operation mode.

The valve unit includes a plurality of on/off valves on the gas refrigerant branch pipelines, the liquid refrigerant branch pipelines, and the connection pipelines.

In another aspect of the present invention, there is provided a method for controlling a multi-unit air conditioner comprising the steps of (a) condensing a portion of gas refrigerant from a compressor at an outdoor heat exchanger, making the other portion to flow through a bypass pipeline in a gas state, and joining the condensed refrigerant and the gas refrigerant, (b) measuring a temperature of the joined gas/liquid mixed refrigerant, (c) detecting the gas/liquid mixing ratio from the measured refrigerant temperature, and (d) controlling a flow rate of the gas refrigerant such that a detected mixing ratio meets a preset mixing ratio required for a required operation mode.

The step (c) includes the step of comparing a preset data on refrigerant mixing ratios versus refrigerant temperatures and the measured temperature, to detect the mixing ratio of the refrigerant. The step (d) includes the step of controlling an opening of the flow rate control valve on the: bypass pipeline for controlling a flow rate of the gas refrigerant flowing through the bypass pipeline.

It is to be understood that both the foregoing description and the following detailed description of the present invention are exemplary and explanatory and are intended to provide further explanation of the invention claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments of the present invention, same parts will be given the same names and reference symbols, and iterative description of which will be omitted.

Figure 1:
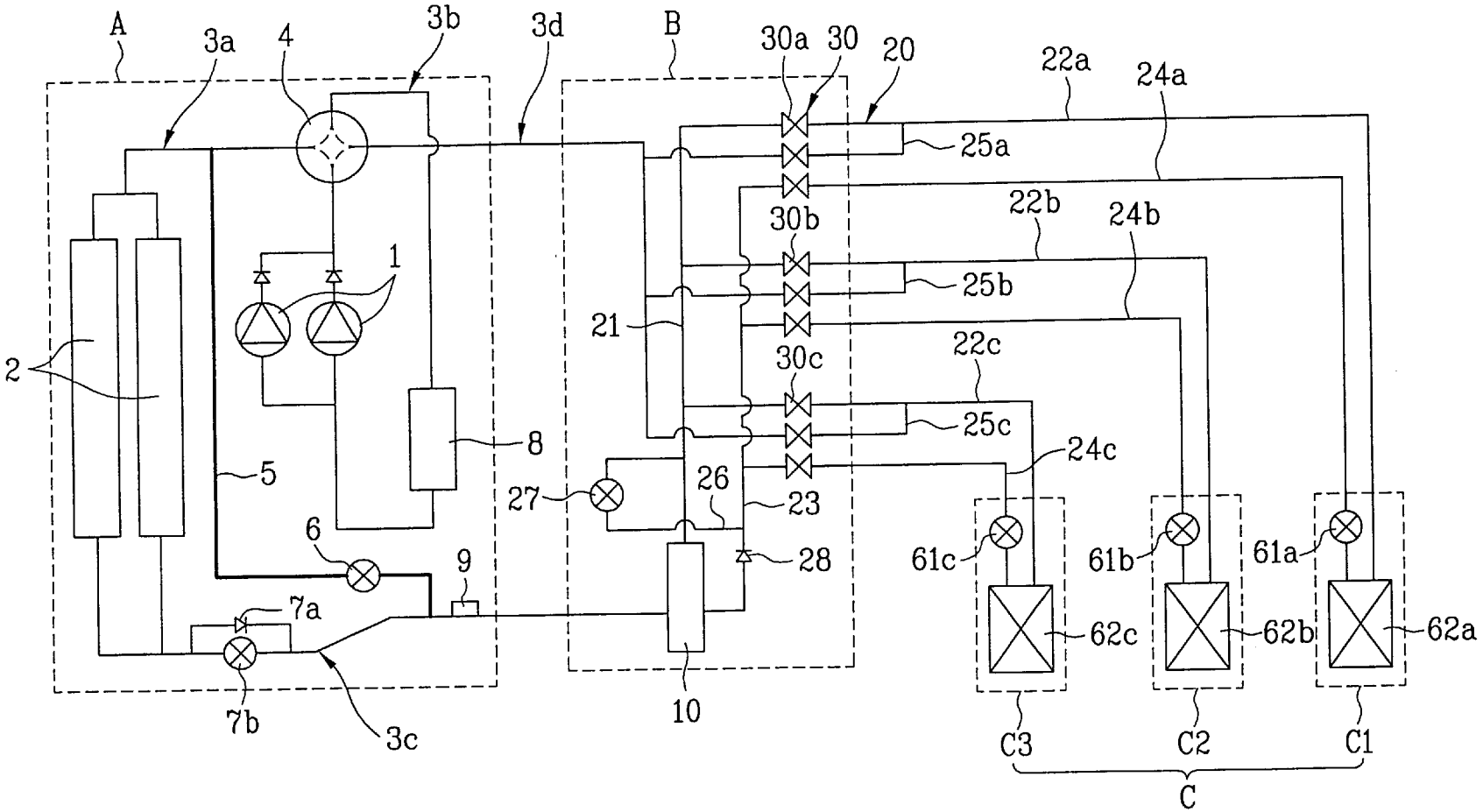
FIG. 1 illustrates a diagram of a multi-unit air conditioner in accordance with a first preferred embodiment of the present invention.

Referring to FIG. 1, the air conditioner in accordance with a preferred embodiment of the present invention includes an outdoor unit 'A', a distributor 'B', and a plurality of indoor units 'C'; 'C1', 'C2', and 'C3'. The outdoor unit 'A' has a compressor 1 and an outdoor heat exchanger 2, and the distributor 'B' has a gas-liquid separator 10 and a distribution piping system 20. Each of the indoor units 'C'; 'C1', 'C2', and 'C3' has an indoor heat exchanger 62 and indoor electronic expansion valve 61.

The air conditioner has a system in which rooms the indoor units 'C'; 'C1', 'C2', and 'C3' are installed therein respectively are cooled or heated individually according to different operation modes of a first operation mode of cooling all rooms, a second operation mode of heating all rooms, a third operation mode of cooling a major number of the rooms and heating a minor number of rooms, and a fourth operation mode of heating a major number of the rooms and cooling a minor number of rooms, detail of one preferred embodiment of which will be described with reference to FIG. 1.

For convenience of description, the following drawing reference symbols 22 represents 22*a*, 22*b*, and 22*c*, 24 represents 24*a*, 24*b*, and 24*c*, 25 represents 25*a*, 25*b*, and 25*c*, 30 represents 30*a*, 30*b*, and 30*c*, 61 represents 61*a*, 61*b*, and 61*c*, 62 represents 62*a*, 62*b*, and 62*c*, and C represents C1, C2, and C3. Of course, a number of the indoor units 'C' and numbers of elements related thereto are varied with a number of rooms, and for convenience of description, the specification describes assuming a case when there are three rooms, i.e., a number of the indoor units are three.

A system of the indoor unit 'A' will be described in detail. Before starting description of the system, a few things that are required to be taken into account in designing the outdoor unit 'A' will be discussed, briefly.

In the first or third operation mode, refrigerant is introduced into the gas-liquid separator 10 through the outdoor heat exchanger 2. In this instance, for improving an air conditioning efficiency, it is preferable that a mixing ratio of the refrigerant, i.e., a mixing ratio of gas refrigerant and liquid refrigerant, is optimized, because of the following reasons.

In the first operation mode, all the indoor units 'C' cool respective rooms, when operation efficiency of the entire indoor units 'C' is the best if the refrigerant introduced into the gas-liquid separator 10 is in a liquid state. Contrary to this, in the third operation mode, some of the indoor units 'C' cool the rooms, and rest of the indoor units 'C' heat the rooms, when operation efficiency of the entire indoor units 'C' is the best if a gas/liquid mixing ratio of the refrigerant introduced into the gas-liquid separator 10 meets a preset mixing ratio. Therefore, for improving the air conditioning efficiency, it is required that the mixing ratio of the refrigerant is optimized to respective operation mode.

The preset mixing ratio is an experimental value determined by experiments set to meet various load conditions, and varied with a number of cooling indoor units and a number of heating indoor units, a flow rate of condensed refrigerant introduced into the cooling indoor units through the heating indoor units, and a number of indoor units in operation and a number of indoor units not in operation.

The simpler the structure and system of the outdoor unit 'A', the better the efficiency of the appliance, owing to reduction of a pipe loss and the like, the simpler the fabrication process, and the lower the cost of the product. Accordingly, it is preferable that the outdoor unit 'A' is designed taking above things into account.

The outdoor unit 'A' of the air conditioner of the present invention designed based on the foregoing description will be described.

Referring to FIG. 1, there is a flow path control valve 4 on an outlet side of the compressor 1 for controlling a flow path of the gas refrigerant from the compressor according to the operation modes. The flow path control valve 4 has four ports, of which first port is in communication with the outlet of the compressor 1.

The second port of the flow path control valve 4 is connected to a first pipeline 3*a* connected to the outdoor heat exchanger 2. The third port of the flow path control valve 4 is connected to a third pipeline 3*b* connected to an inlet of the compressor 1. Thus, the first pipeline 3*a* makes the second port and the outdoor heat exchanger 2 in communication, and the third pipeline 3*b* connects the third port and the inlet of the compressor 1. In the first or third operation mode, the flow path control valve 4 is controlled such that the outlet of the compressor 1 and the first pipeline 3*a* are in communication, and the third and fourth pipelines 3*b* and 3*d* are in communication. In the second or fourth operation mode, the flow path control valve 4 is controlled such that the outlet of the compressor 1 and the fourth pipeline 3*d* are in communication, and the first and third pipelines 3*a* and 3*b* are in communication. An accumulator 8 is provided on the third pipeline 3*b*.

The fourth port of the flow path control valve 4 is connected to the fourth pipeline 3*d* connected to the distributor 'B'. The second pipeline 3*c* connects the outdoor heat exchanger 2 and the distributor 'B', more specifically, the gas-liquid separator 10 which will be described in more detail, later. Accordingly, the outdoor unit 'A' and the distributor 'B' are connected to each other with the second and fourth pipelines 3*c* and 3*d*. Since the outdoor unit 'A' and the distributor 'B' are connected only with two pipelines, the installation of the air conditioner of the present invention is very simple and easy.

Referring to FIG. 1, the first pipeline 3*a* and the second pipeline 3*c* are connected with a first bypass pipeline 5. The first bypass pipeline 5 has a flow rate control valve 6 mounted thereon, for controlling a flow rate of gas refrigerant flowing through the first bypass pipeline 5. The flow rate control valve 6 controls an opening of the first bypass pipeline 5 under the control of a microcomputer (not shown) to be described later. The flow rate control valve 6 is fully closed in the first, second, and fourth operation modes, and controlled of opening thereof for controlling the flow rate of gas refrigerant flowing through the first bypass pipeline 5.

The second pipeline 3*c* has a first electronic expansion valve 7*b* and a first check valve 7*a* further mounted thereon. The first electronic expansion valve 7*b* is mounted at a point of the second pipeline 3*c* between a point the first bypass pipeline 5 joins thereto and an end thereof connected to the outdoor heat exchanger 2. As shown in FIG. 1, the first check valve 7*a* is mounted in parallel with the first electronic expansion valve 7*b*. The first check valve passes refrigerant flowing from the outdoor heat exchanger 2 to the distributor 'B', and blocks refrigerant flowing from the distributor 'B' to the outdoor heat exchanger 2. In this instance, the first electronic expansion valve 7*b* is closed fully when the refrigerant flows from the outdoor heat exchanger 2 to the distributor 'B', inducing the refrigerant to flow through the first check valve 7*a*. The first electronic expansion valve 7*b* is controlled to expand the refrigerant when the refrigerant flows from the first bypass pipeline 5 or the distributor 'B' to the outdoor heat exchanger 2. In the meantime, the first electronic expansion valve 7*b* and the first check valve 7*a* may not be provided if a second electronic expansion valve 27 and a second check valve 28, which will be described later, are provided, it is preferable that all of the first and second electronic expansion valves 7*b* and 27 and the first and second check valves 7*a* and 28 are provided.

In the meantime, opening of the flow rate control valve 6 is controlled by control means. The control means includes a temperature sensor 9 and a microcomputer (not shown), for controlling the flow rate control valve 6, to regulate a flow rate of the refrigerant flowing in the first bypass pipeline 5, and thereby regulating the mixing ratio of the refrigerant according to respective operation modes.

The temperature sensor 9 is mounted on the second pipeline 3*c*, in more detail, on the second pipeline 3*c* between a point the first bypass pipeline 5 is connected thereto and the distributor 'B'. The temperature sensor measures a temperature of gas/liquid mixed refrigerant flowing through the second pipeline 3*c* after the gas refrigerant in the first bypass pipeline 5 and the gas refrigerant passed through the outdoor heat exchanger 2 join.

Information on the temperature of the mixed refrigerant measured at the temperature sensor 9 is transmitted to the microcomputer, and the microcomputer compares the refrigerant temperature measured at the temperature sensor 9 and a preset reference data, to detect the mixing ratio of the refrigerant. The reference data is experimental values having a preset mixing ratio for each temperature, obtained from experiments done under different conditions.

Next, it is required that the distributor 'B' guides the refrigerant received from the outdoor unit 'A' to selected indoor units 'C' exactly according to operation modes of the indoor units. Moreover, it is preferable that a plurality of pipelines connected between the distributor 'B' and the plurality of indoor units are simplified, for easy piping work and better outer appearance.

Referring to FIG. 1, the distributor 'B' of the air conditioner of the present invention, designed taking above things into account, includes the gas-liquid separator 10, the distribution piping system 20, and a valve unit 30.

The gas-liquid separator 10 separates the refrigerant from the indoor units 'A' into gas refrigerant and liquid refrigerant. The gas-liquid separator 10 has a liquid port for discharging liquid refrigerant and a gas port for discharging gas refrigerant. The gas-liquid separator 10 is connected to the second pipeline 3*c* of the outdoor unit 'A', and the gas port and the liquid port are connected to one of pipelines in the distribution piping system 20.

The distribution piping system 20 guides the refrigerant received at the distributor 'B' from the outdoor unit 'A' to the indoor units 'C', and the refrigerant received at the distributor 'B' from the indoor units 'C' to the outdoor unit 'A'. The distribution piping system 20 includes a gas refrigerant pipeline 21, a liquid refrigerant pipeline 23, gas refrigerant branch pipelines 22, liquid refrigerant branch pipelines 24, and connection pipelines 25, of which details are as follows.

The gas refrigerant pipeline 21 has one ends connected the gas port of the gas-liquid separator 10. As shown in FIG. 1, a plurality of the liquid refrigerant branch pipelines 24 are branched from the liquid refrigerant pipeline 23. The liquid refrigerant branch pipelines 24 are connected to the indoor electronic expansion valves 61 of the indoor units 'C', respectively.

Referring to FIG. 1, the connection pipelines 25 are respectively branched from the gas refrigerant branch pipelines 22, and connected to the fourth pipeline 3*d* of the outdoor unit 'A'. As shown in FIG. 1, the connection pipelines 25 may join into one pipeline in the distributor 'B', and connected to the fourth pipeline 3*d*.

The valve unit 30 controls refrigerant flow in the distribution piping system 20, such that gas or liquid refrigerant is selectively introduced into respective indoor units 'C' in the rooms, and the gas or liquid refrigerant passed through the indoor units 'C' is reintroduced into the outdoor unit 'A'. As shown in FIG. 1, the valve unit 30, working thus, includes a plurality of on/off valves 30; 30*a*, 30*b*, and 30*c* mounted and controlled on the gas refrigerant branch pipelines 22, the liquid refrigerant branch pipelines 24, and the connection pipelines 25. Detailed control of the valve unit 30 will be described at the time of description of operation of the air conditioner for each of the modes.

Next, each of the indoor units 'C' in respective rooms includes the indoor heat exchanger 62, the electronic expansion valve 61, and the indoor fan (not shown). The indoor heat exchanger 62 is connected to one of the gas refrigerant branch pipelines 22 in the distributor 'B', and the electronic expansion valve 61 is connected to one of the liquid refrigerant branch pipeline 24 in the distributor 'B'. The indoor heat exchanger 62 and the electronic expansion valve 61 are connected with a refrigerant pipeline to each other. The indoor fan is provided to blow air toward the indoor heat exchanger 62.

The foregoing multi-unit air conditioner of the present invention cools or heats respective rooms individually as the gas refrigerant from the compressor 1 is involved in flow passage and flow direction changes at the outdoor unit 'A' under the control of the flow path control valve 4, and involved in flow passage and flow direction changes at the distributor 'B' and the indoor units 'B' under the control of the valve unit 30. Hereafter, how the refrigerant flows, and cools or heats respective rooms under the control of the flow path control valve 4, and the valve unit 30 will be described in detail for each of the modes. For convenience of description, it is assumed that two indoor unit C2 and C3 cool the rooms, and rest one indoor unit C1 heats the room in the second operation mode. It is also assumed that two indoor unit C1 and C2 heat the rooms and rest one indoor unit C3 cools the room in the fourth operation mode.

Figure 2A:
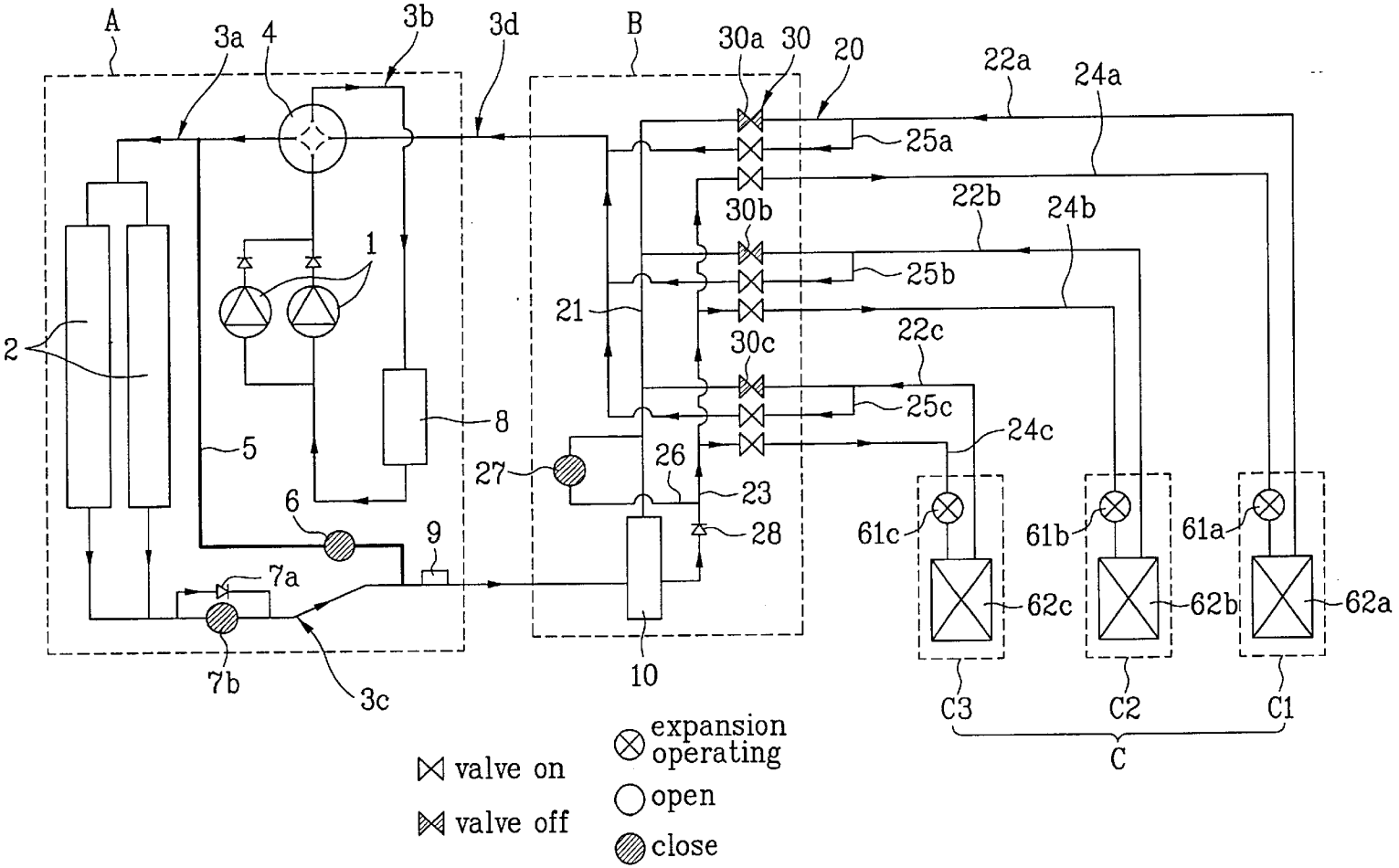
FIG. 2A illustrates a diagram showing an operation state of the multi-unit air conditioner in FIG. 1 when all rooms are cooled.

FIG. 2A illustrates a diagram showing an operation state of the multi-unit air conditioner in FIG. 1 in the first operation mode. In the first operation mode, when all the indoor units cool the rooms, entire refrigerant from the compressor 1 is introduced into the distributor 'B' after passed through the outdoor heat exchanger 2, and returns to the compressor 1 again through the indoor units 'C' and the distributor 'B', of which circulation path is as follows.

Referring to FIG. 2A, in the first operation mode, the flow path control valve 4 is controlled such that the outlet of the compressor 1 and the first pipeline 3*a* are in communication, and the third pipeline 3*b* and the fourth pipeline 3*a* are in communication. Therefore, the gas refrigerant flows from the compressor 1 to the first pipeline 3*a*. Since the flow rate control valve 6 on the first bypass pipeline 5 connected to the first pipeline 3*a* is closed fully, entire refrigerant passes the outdoor heat exchanger 2, and is introduced into the gas-liquid separator 10 in the distributor 'B'. In this instance, the gas refrigerant is liquefied at the outdoor heat exchanger 2, preferably, entirely. On the other hand, since the first electronic valve 7*b* is closed fully, the refrigerant passed through the outdoor heat exchanger 2 is introduced into the gas-liquid separator 10 in the distributor 'B' after passing through the first check valve 7*a*.

The high pressure liquid refrigerant introduced into the gas-liquid separator 10 flows through the liquid refrigerant pipeline 23 entirely, because all the valves on the gas refrigerant branch pipelines 22 connected to the gas refrigerant pipeline 21 are closed as shown in FIG. 2A.

The liquid refrigerant is introduced from the liquid refrigerant pipeline 23 to the liquid refrigerant branch pipelines 24, expanded at the indoor electronic expansion valves 61 of the indoor units 'C', and introduced into the indoor heat exchangers 62. The refrigerant heat exchanges with the room air at the indoor heat exchangers 62, and the air cooled as it heat exchanges with the refrigerant is blown into the room space by the indoor fan, to cool down the room space.

The refrigerant heat exchanged with the room air turns into gas refrigerant, introduced into the distributor 'B' through the gas refrigerant branch pipelines 22. Then, the refrigerant is introduced into the fourth pipeline 3*d*, and therefrom into the inlet of the compressor 1 through the third pipeline 3*b* and the accumulator 8.

Figure 2B:
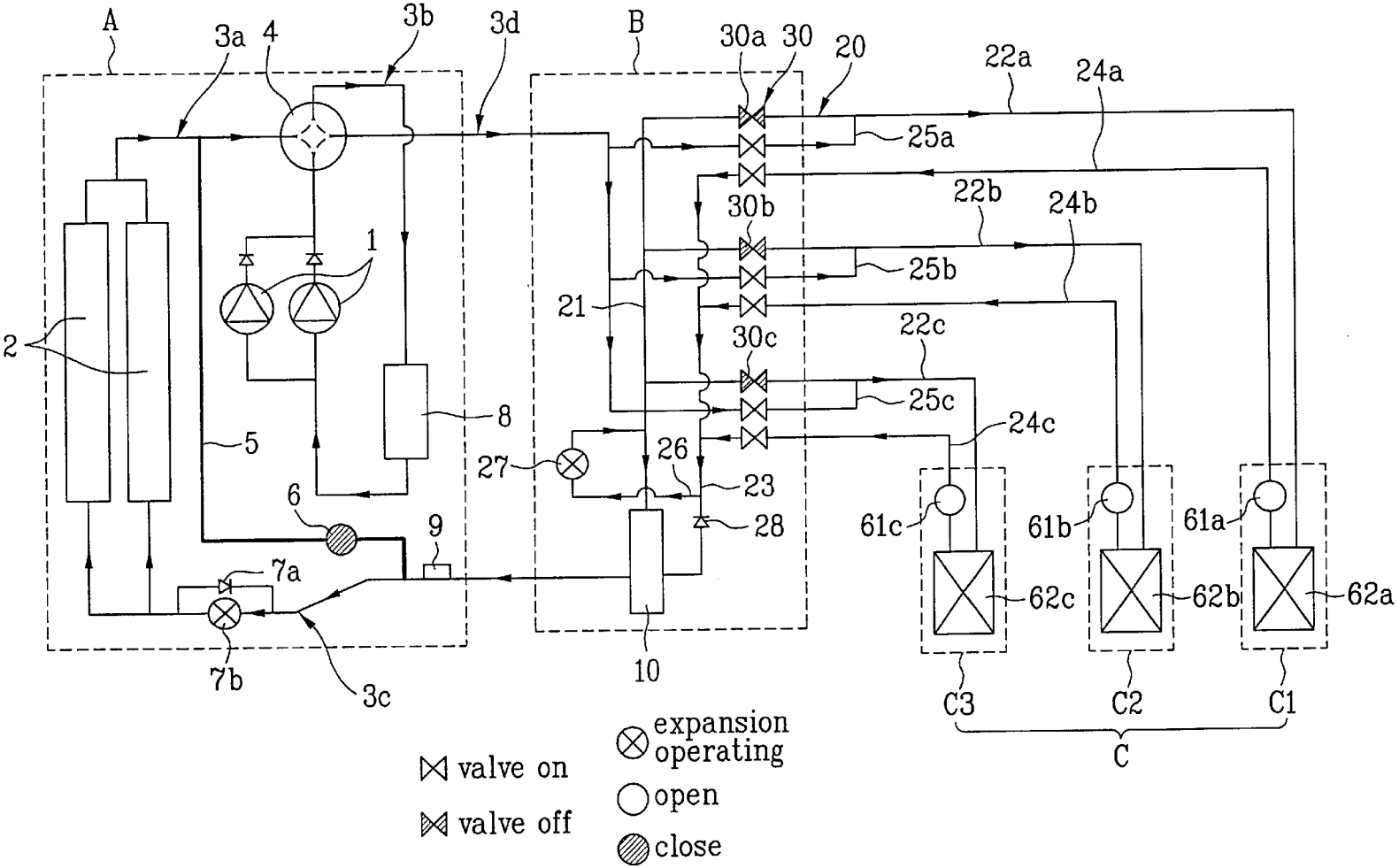
FIG. 2B illustrates a diagram showing an operation state of the multi-unit air conditioner in FIG. 1 when all rooms are heated.

FIG. 2B illustrates a diagram showing an operation state of the multi-unit air conditioner in FIG. 1 in the second operation mode. The second operation mode, when all the indoor units heat the rooms, has a circulation path in which the refrigerant from the compressor 1 returns to the compressor 1 in the outdoor unit 'A' through the distributor 'B' after the refrigerant is introduced into the indoor units 'C' through the fourth pipeline 3*d* and the distributor 'B', of which detail is as follows.

Referring to FIG. 2B, the gas refrigerant is introduced from the compressor 1 to the fourth pipeline 3*d* under the control of the flow path control valve 4. In the second operation mode, the flow path control valve 4 is controlled such that the outlet of the compressor 1 and the fourth pipeline 3*d* are connected, and, at the same time, the first pipeline 3*a* and the third pipeline 3*b* are connected.

Referring to FIG. 2B, the gas refrigerant introduced into the distributor 'B' through the fourth pipeline 3*d* is introduced into the indoor heat exchangers 62 through the connection pipelines 25 and the gas refrigerant branch pipelines 22. In the second operation mode, the valve unit 30 is controlled such that all the valves only on the gas refrigerant branch pipelines 22 are closed.

The gas refrigerant introduced into the indoor heat exchanger 62 is condensed as the gas refrigerant heat exchanges with the room air. The room air becomes warm as the refrigerant discharges a condensing heat when the refrigerant condenses. The warm room air is then discharged into the room space by the indoor fan. The liquid refrigerant, condensed as the refrigerant heat exchanges with the room air, passes through opened indoor electronic expansion valves 61, and introduced into the liquid refrigerant pipeline 23 through the liquid refrigerant branch pipelines 24.

The refrigerant flows from the liquid refrigerant branch pipelines 24 toward the gas-liquid separator 10 until the second check valve 28 blocks, when the refrigerant is introduced into the second bypass pipeline 26. The refrigerant introduced into the second bypass pipeline 26 expands at the second electronic expansion valve 27, and introduced into the gas-liquid separator 10. The liquid refrigerant is introduced from the gas-liquid separator 10, not to the liquid refrigerant pipeline 23, but to the second pipeline 3*c* owing to a pressure difference.

The refrigerant introduced into the outdoor unit 'A' through the second pipeline 3*c* is introduced toward the first electronic expansion valve 7*b* because the flow rate control valve 6 on the second bypass pipeline 26 is closed fully. The refrigerant expands at the first electronic expansion valve 7*b* again, is vaporized at the outdoor heat exchanger 2, and introduced into the first pipeline 3*a*. The gas refrigerant introduced into the first pipeline 3*a* is drawn into the inlet of the compressor 1 after passing through the flow path control valve 4, the third pipeline 3*b*, and the accumulator 8 in succession.

Figure 3A:
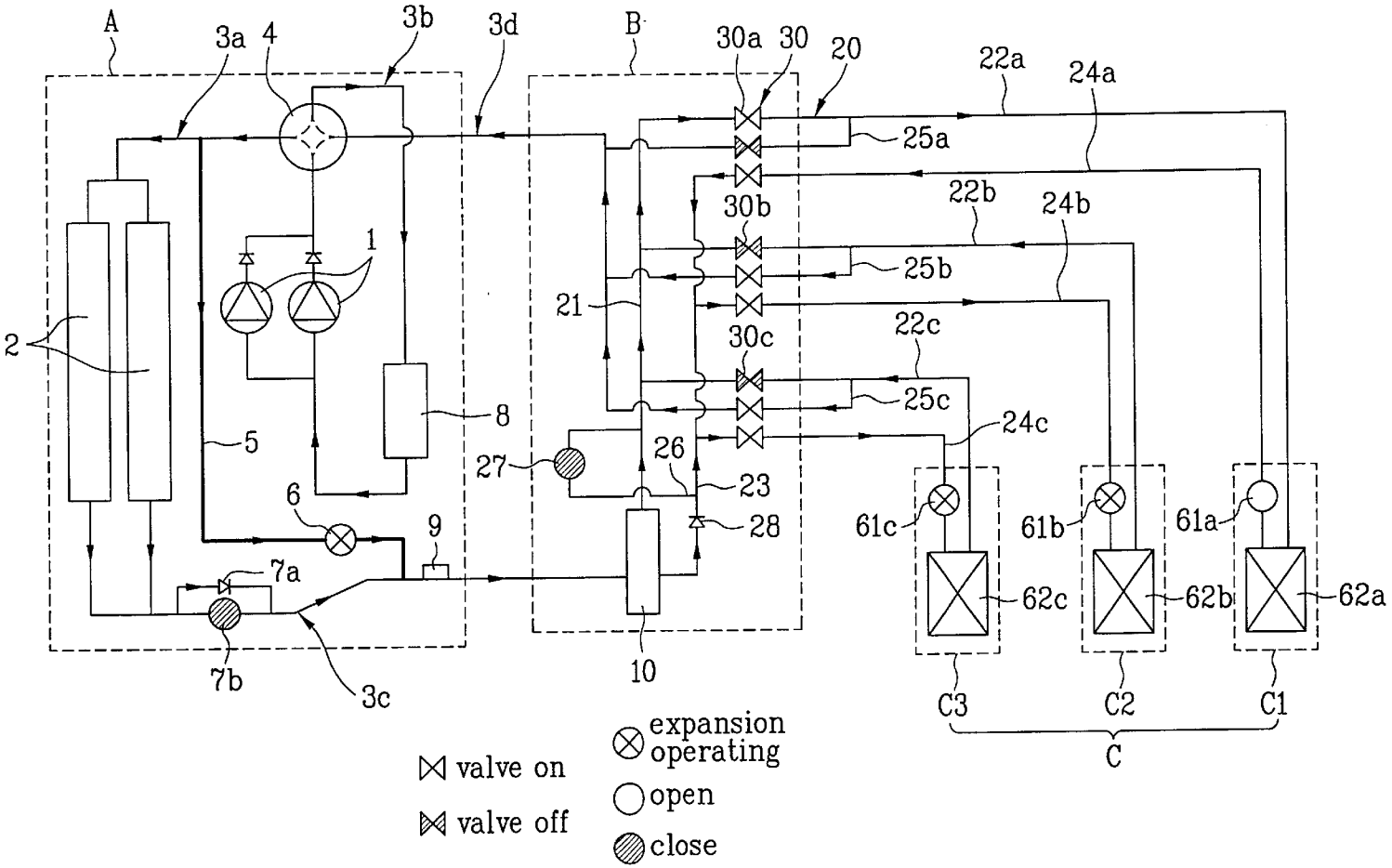
FIG. 3A illustrates a diagram showing an operation state of the multi-unit air conditioner in FIG. 1 when a major number of rooms are cooled and a minor number of rooms are heated.

FIG. 3A illustrates a diagram showing an operation state of the multi-unit air conditioner in FIG. 1 in the third operation mode. In the third operation mode, when a major number of rooms are cooled and a minor number of rooms are heated, the refrigerant from the compressor 1 is introduced into the gas-liquid separator 10 after a portion of the refrigerant passes through the outdoor heat exchanger 2 and rest of the refrigerant passes through the first bypass pipeline 5. Then, gas refrigerant and liquid refrigerant are introduced into indoor units 'C' through different paths, and cool or heat respective rooms individually, of which detail will be described.

Referring to FIG. 3A, the gas refrigerant is introduced into the first pipeline 3*a* from the compressor 1 under the control of the flow path control valve 4. In the third operation mode, the flow path control valve 4 is controlled identical to the first mode.

A portion of the refrigerant is introduced into the outdoor heat exchanger 2 from the first pipeline 3*a*, and rest of the refrigerant is introduced into the first bypass pipeline 5. Because, in the third operation mode, different from the first operation mode, the flow rate control valve 6 on the first bypass pipeline 5 is opened to a required opening for the refrigerant to flow at a required rate by the control means.

The portion of the refrigerant introduced into the outdoor heat exchanger 2 is liquefied, and introduced into the second pipeline 3*c*, and the rest of the refrigerant is introduced into the second pipeline 3*c* in a gas state. The first electronic expansion valve 7*b* is fully closed in the third operation mode. The refrigerant joined at the second pipeline 3*c* is two phase refrigerant. A temperature of the two phase refrigerant is measured with the temperature sensor on the second pipeline 3*c*.

The temperature sensor 9 measures the temperature of the two phase refrigerant at the second pipeline 3*c* and transmits to the microcomputer. The microcomputer receives the measured temperature, compares to the reference data, and detects the mixing ratio of the refrigerant. Then, the opening of the flow rate control valve 6 is controlled so that the detected mixing ratio meets a mixing ratio required in the third operation mode, in more detail, a mixing ratio proper to the rooms. The control of the opening of the flow rate control valve 6 controls a flow rate of the gas refrigerant introduced through the first bypass pipeline 5, thereby controlling the mixing ratio of the refrigerant easily.

Thus, in the third operation mode, by controlling the opening of the flow rate control valve 6, an optimal gas/liquid refrigerant mixing ratio required for operation can be provided. By distributing the mixed refrigerant having the optimal mixing ratio to the indoor units 'C', the air conditioning system can cool or heat the rooms, individually. A method for providing the optimal refrigerant mixing ratio required for the individual cooling or heating of the rooms in the third operation mode thus will be summarized briefly as follows.

First, a portion of gas refrigerant compressed at the compressor 1 is condensed at the outdoor heat exchanger 2, and rest of the gas refrigerant is made to flow through the first bypass pipeline 5 in a gas state, and the condensed liquid refrigerant and the gas refrigerant are joined at the second pipeline 3*c*.

A temperature of the joined gas/liquid refrigerant is measured at the temperature senor 9 on the second pipeline 3*c*.

Next, a gas/liquid refrigerant mixing ratio is detected from the measured refrigerant temperature. In this instance, a method is used, in which a preset data on refrigerant mixing ratio versus refrigerant temperature is compared to the measured temperature, for detecting the refrigerant mixing ratio.

Finally, a flow rate of the gas refrigerant is controlled such that the detected mixing ratio meets a preset mixing ratio required for the operation mode. In this instance, by controlling opening of the flow rate control valve 6 on the first bypass pipeline 5, the flow rate flowing through the first bypass pipeline 5 can be controlled.

The refrigerant mixing ratios preset at the microcomputer of control means are experimental values fixed according to experiments done under different loads, and set proper to the two cooling side indoor units C2 and C3 that require liquid refrigerant, and one heating side indoor unit C3 that requires gas refrigerant, and a flow rate of the liquid refrigerant introduced into the two cooling side indoor units C2 and C3 through the one heating side indoor unit C1.

In the meantime, the refrigerant made to have an optimal mixing ratio by above method is introduced into the gas-liquid separator 10. Gas refrigerant flows from the gas-liquid separator 10 toward the gas refrigerant pipeline 21, and the liquid refrigerant flows from the gas-liquid separator 10 toward the liquid refrigerant pipeline 23. As shown in FIG. 3, in the third operation mode, the valve unit 30 is controlled such that the valves on the connection pipeline 25*a* branched from the gas refrigerant branch pipelines 22*a* connected to the indoor unit C1 and the gas refrigerant branch pipelines 22*b* and 22*c* are closed (turned off). In the third operation mode, the second electronic expansion valve 27 on the second bypass pipeline 26 is closed, fully.

The liquid refrigerant is introduced into the liquid refrigerant branch pipelines 24*b* and 24*c* from the liquid refrigerant pipeline 23, expands at the indoor electronic expansion valves 61*b* and 61*c*, and introduced into the indoor heat exchangers 62*b*, and 62*c* to cool the room spaces. The refrigerant having cooled the rooms at the indoor units C2 and C3 turns into a gas state, and introduced into the connection pipelines 25*b* and 25*c* through the gas refrigerant branch pipelines 24*b* and 24*c*. Then, the refrigerant is drawn to the inlet of the compressor 1 after passing through the fourth pipeline 3*d*, the third pipeline 3*b*, and the accumulator 8.

On the other hand, the gas refrigerant, separated at the gas-liquid separator 10 and introduced into the gas refrigerant pipeline 21, is introduced into the gas refrigerant branch pipeline 22*a*. Because the valves on the gas refrigerant branch pipelines 22*b* and 22*c* respectively connected to the indoor units C2 and C3 for cooling the rooms are closed (turned oft).

The gas refrigerant, introduced into the gas refrigerant branch pipeline 22*a*, is introduced into the indoor heat exchanger 62*a* of the indoor unit C1 which is to heat the room, heats the room space and is turned into a liquid refrigerant, and, thereafter introduced into the liquid refrigerant pipeline 23 through the indoor electronic expansion valve 61*a* and the liquid refrigerant branch pipeline 24*a*.

The refrigerant, introduced into the liquid refrigerant pipeline 23, joins with the liquid refrigerant from the gas-liquid separator 10, introduced into the indoor units C2 and C3, which are to cool the rooms, cools the rooms, and introduced into the compressor 1 through above path.

In the meantime, a reason the liquid refrigerant is not introduced into the liquid refrigerant branch pipeline 24*a* connected to the indoor unit C1, which is to heat the room, during above process in the third operation mode is owing to a pressure of the refrigerant introduced into the liquid refrigerant pipeline 23 after heating the room.

Figure 3B:
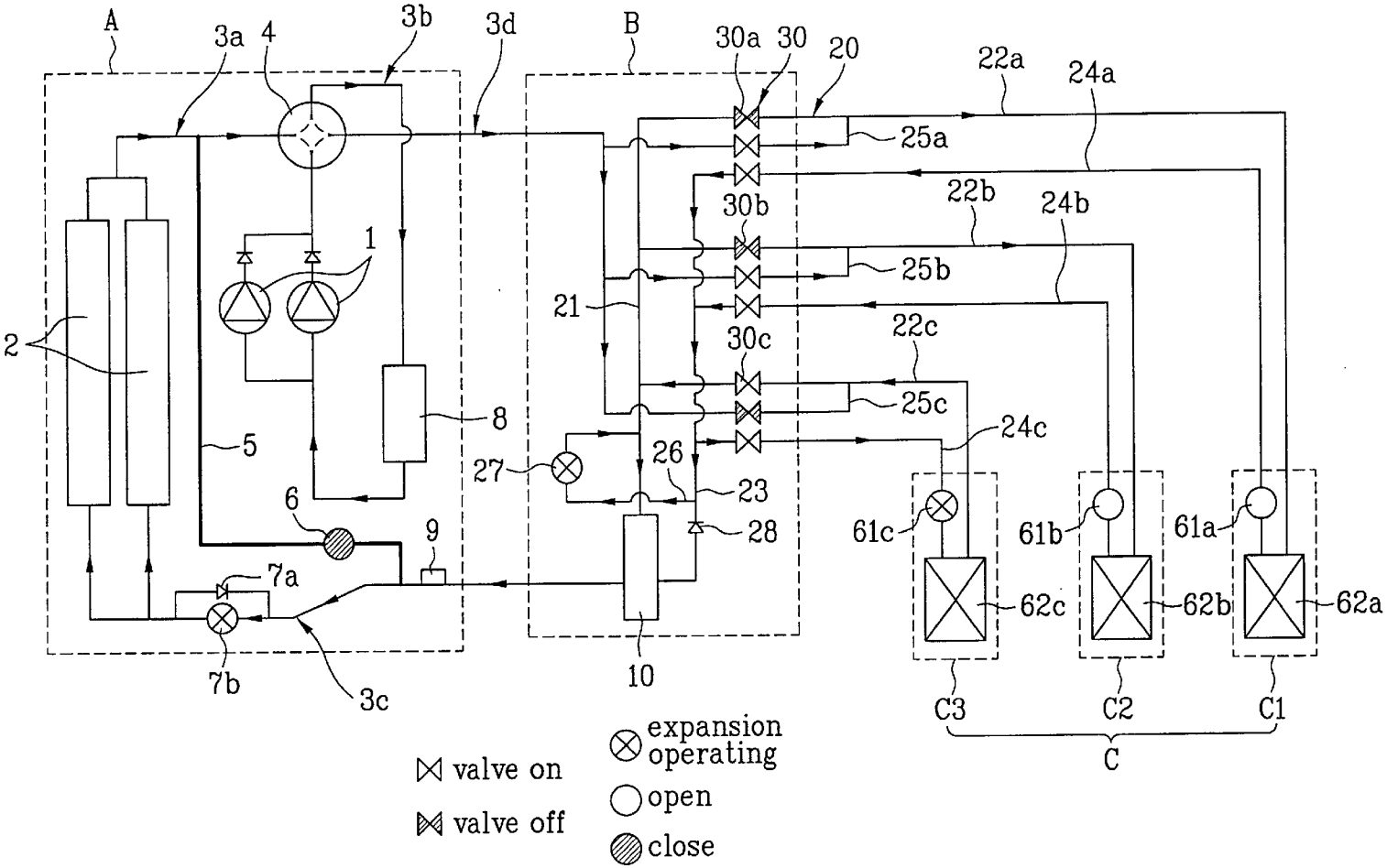
FIG. 3B illustrates a diagram showing an operation state of the multi-unit air conditioner in FIG. 1 when a major number of rooms are heated and a minor number of rooms are cooled.

FIG. 3B illustrates a diagram showing an operation state of the multi-unit air conditioner in FIG. 1 in a fourth operation mode. In the fourth operation mode when a major number of rooms are heated and a minor number of rooms are cooled, the refrigerant is introduced from the compressor 1 to the fourth pipeline 3*d*, and cools or heats the rooms individually as the refrigerant passes through the distributor 'B' and the indoor units 'C', of which detail will be described.

Referring to FIG. 3B, the gas refrigerant is introduced into the fourth pipeline 3*d* from the compressor 1 under the control of the flow path control valve 4, and introduced into the distributor 'B'. In the fourth operation mode, the flow path control valve 4 is controlled identical to the second operation mode.

The gas refrigerant, introduced into the distributor, is introduced into the gas refrigerant branch pipelines 22*a* and 22*b* through the connection pipelines 25*a* and 25*b* branched from the gas refrigerant branch pipelines 22*a* and 22*b* connected to the indoor units C1 and C2 which to heat the rooms. This is because, in the fourth operation mode, the valve on the connection pipeline 25*c*, branched from the gas refrigerant branch pipeline 33*c* connected to the indoor unit C3 which is to cool the room, is closed (turned off). The valves on the gas refrigerant branch pipelines 22*a* and 22*b* connected to the indoor units C1 and C2 which to heat the rooms are also closed.

The gas refrigerant introduced into the gas refrigerant branch pipelines 22*a* and 22*b* heats the room spaces as the gas refrigerant passes through the indoor heat exchangers 62*a* and 62*b*. The liquid refrigerant liquefied at the indoor units C1 and C2 passes through the indoor electronic expansion valves 61*b* and 61*c*, and is introduced into the liquid refrigerant pipeline 23 through the liquid refrigerant branch pipelines 24*a* and 24*b*.

A portion of the liquid refrigerant, introduced into the liquid refrigerant pipeline 23, is introduced into the second bypass pipeline 26 guided by the second check valve 28, and therefrom into the gas-liquid separator 10 after expanded at the second electronic expansion valve 27. The gas refrigerant, introduced into the gas-liquid separator 10, is drawn into the inlet of the compressor 1 via a path the same with the path described in the second operation mode, i.e., the second pipeline 3*c*, the first electronic expansion valve 7*b*, the outdoor heat exchanger 2, the first pipeline 3*a*, the third pipeline 3*b*, and the accumulator 8.

In the meantime, as shown in FIG. 3B, a portion of the liquid refrigerant introduced into the liquid refrigerant pipeline after passing through the indoor units C1 and C2 is introduced into the liquid refrigerant branch pipeline 24*c* connected to the indoor unit C3 which is to cool the room. The refrigerant, cooled the room as the refrigerant passes through the indoor unit C3, is introduced into the gas refrigerant branch pipeline 22*c*, and, therefrom into the gas-liquid separator 10 through the gas refrigerant pipeline 21. The refrigerant, introduced into the gas-liquid separator 10 heats the rooms as the refrigerant passes through the indoor units C1 and C2, and joins with the refrigerant introduced into the gas-liquid separator 10 directly, and is drawn into the inlet of the compressor 1 through a path the same with above.

As has been described, the multi-unit air conditioner and method for controlling the same of the present invention have the following advantages.

First, the multi-unit air conditioner of the present invention enables an optimal dealing with individual room environments. That is, not only all room heating operation when all rooms are heated, or all room cooling operation when all rooms are cooled, but also an operation in which a major number of rooms are heated and a minor number of rooms are cooled, or an operation in which a major number of rooms are cooled and a minor number of rooms are heated, i.e., the rooms are cooled or heated selectively, are possible, permitting to deal with individual room environments.

Second, instead of expensive three, and four way valves, low priced simple on/off valves can be used, which reduces a production cost.

Third, the mounting of the gas-liquid separator, not on the distributor, but on the outdoor unit, which enables to reduce a weight of the distributor, permits an easy installation of the distributor, and secure safety after installation, further. This is because in general installation of the distributor 'B' is more difficult than installation of the outdoor unit 'A' since the outdoor unit 'A' is installed on an outdoor wall or floor while the distributor 'B' is installed on indoor ceiling, particularly, if the distributor 'B' is heavy, when installation of the distributor 'B' is, not only difficult, but also requires reinforcement of support, and in an worst case, the distributor can drop down from the ceiling.

Fourth, the optimization of the gas-liquid mixing ratio of the two phase refrigerant introduced into the gas-liquid separator in the operations all rooms are cooled, and a major number of rooms are cooled and a minor number of rooms are heated improves an air conditioning efficiency.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. A multi-unit air conditioner comprising:

an outdoor unit including;

a flow path control valve for controlling a flow path of refrigerant from a compressor, outdoor heat exchanger having one side in communication with the flow path control valve, a first bypass pipeline having one end connected to the first pipeline which makes the flow path control valve and the outdoor heat exchanger to be in communication, and the other end connected to the second pipeline connected to the other end of the outdoor heat exchanger, and a flow rate control valve provided on the first bypass pipeline for controlling a flow rate of the refrigerant passing through the first bypass pipeline;

an indoor unit having an indoor heat exchanger and indoor electronic expansion valve installed in each of rooms;

a distributor for selective distribution of the refrigerant received through one of two pipelines connected to the outdoor unit to the indoor units, and returning to the outdoor unit through the other one pipeline; and controlling means for measuring a gas/liquid mixing ratio of the refrigerant introduced into the distributor, the refrigerant having joined after respectively passing through the first bypass pipeline and the outdoor heat exchanger, for controlling an opening of the flow rate control valve, to control the mixing ratio.

2. The multi-unit air conditioner as claimed in claim 1, wherein the operation mode includes;

a first operation mode for cooling all rooms, a second operation mode for heating all rooms, a third operation mode for cooling a major number of rooms and heating a minor number of rooms, and a fourth operation mode for heating a major number of rooms and cooling a minor number of rooms.

3. The multi-unit air conditioner as claimed in claim 2, wherein the distributor is made to be in communication with the outdoor unit with a fourth pipeline having one end connected to the flow path control valve and a second pipeline having one end connected to the outdoor heat exchanger.

4. The multi-unit air conditioner as claimed in claim 3, wherein the flow control valve includes;

a first port in communication with an inlet of the compressor, a second port connected to the first pipeline, a third port having one end connected to the other end of the third pipeline connected to an outlet of the compressor, and a fourth port connected to one end of the fourth pipeline.

5. The multi-unit air conditioner as claimed in claim 4, wherein the flow path control valve makes the outlet of the compressor and the first pipeline in communication, and the third and fourth pipelines in communication in the first and third operation modes.

6. The multi-unit air conditioner as claimed in claim 4, wherein the flow path control valve makes the outlet of the compressor and the fourth pipeline in communication, and the first and third pipelines in communication in the second and fourth operation modes.

7. The multi-unit air conditioner as claimed in claim 3, wherein the indoor unit further includes an accumulator mounted on the third pipeline.

8. The multi-unit air conditioner as claimed in claim 3, wherein the controlling means includes;

a temperature sensor provided on the second pipeline for measuring a temperature of gas/liquid mixed refrigerant joined after respectively passing through the outdoor heat exchanger and the first bypass pipeline, and a microcomputer for comparing the refrigerant temperature measured by the temperature sensor and a preset refrigerant temperature, to detect the gas/liquid refrigerant mixing ratio, and controlling an opening of the flow rate control valve for making a detected mixing ratio to meet the preset mixing ratio required for a required operation mode.

9. The multi-unit air conditioner as claimed in claim 8, wherein the flow rate control valve is fully closed in the first, second, or fourth operation mode, and has the opening thereof controlled by the microcomputer in the third operation mode.

10. The multi-unit air conditioner as claimed in claim 3, wherein the outdoor unit further includes;

a first electronic expansion valve mounted on the second pipeline between the other end of the outdoor heat exchanger and the first bypass pipeline, and a first check valve mounted in parallel with the first electronic expansion valve for passing refrigerant flowing only from the outdoor heat exchanger toward the distributor.

11. The multi-unit air conditioner as claimed in claim 10, wherein the first electronic expansion valve is controlled such that the first electronic expansion valve is fully closed in the first or third operation mode, and expands the refrigerant flowing from a distributor side to an outdoor heat exchanger side in the second or fourth mode.

12. The multi-unit air conditioner as claimed in claim 3, wherein the distributor makes the gas refrigerant introduced thereto from the outdoor unit to flow toward indoor unit heat exchangers which are to heat the rooms, the liquid refrigerant introduced thereto from the outdoor unit toward electronic expansion valves of the indoor units which are to cool the rooms, and the refrigerant passed through the indoor units to flow to the outdoor unit again, wherein, in a case heating or cooling of the rooms are carried out individually, the refrigerant liquefied as the refrigerant passes through the indoor unit which is to heat the room is made to flow toward the electronic expansion valve of the indoor unit which is to cool the room before making the refrigerant to flow to the outdoor unit.

13. The multi-unit air conditioner as claimed in claim 12, wherein the distributor includes;

a gas-liquid separator connected to the second pipeline for separating gas/liquid mixed refrigerant received from the second pipeline into gas refrigerant and liquid refrigerant, a distribution piping system for guiding the refrigerant from the outdoor unit to the indoor units, and from the indoor units to the outdoor unit, and a valve unit on the distribution piping system for controlling flow of the refrigerant in the distribution piping system to be consistent with respective modes.

14. The multi-unit air conditioner as claimed in claim 13, wherein the distribution piping system includes;

a gas refrigerant pipeline connected to a gas port of the gas-liquid separator, a liquid refrigerant pipeline connected to a liquid port of the gas-liquid separator, liquid refrigerant branch pipelines branched from the liquid refrigerant pipeline and connected to the indoor expansion valves in the indoor units, respectively, gas refrigerant branch pipelines branched from the gas refrigerant pipeline and connected to the indoor heat exchangers, respectively, and connection pipelines respectively branched from the gas refrigerant branch pipelines and connected to the fourth pipeline.

15. The multi-unit air conditioner as claimed in claim 14, wherein the distributor further includes;

a second bypass pipeline having one end connected to the liquid refrigerant pipeline adjacent to the liquid port, and the other end connected to the gas refrigerant pipeline adjacent to the gas port, a second check valve on the liquid refrigerant pipeline between the one end of the bypass pipeline and the liquid port, for making the refrigerant to flow from a liquid port side toward the liquid refrigerant branch pipeline side, and a second electronic expansion valve on the second bypass pipeline.

16. The multi-unit air conditioner as claimed in claim 15, wherein the second electronic expansion valve is controlled such that the second electronic expansion valve is closed fully in the first or third operation mode, and causes the refrigerant to expand in the second or fourth operation mode.

17. The multi-unit air conditioner as claimed in claim 14, wherein the valve unit includes a plurality of on/off valves on the gas refrigerant branch pipelines, the liquid refrigerant branch pipelines, and the connection pipelines.

18. The multi-unit air conditioner as claimed in claim 1, wherein the indoor electronic expansion valve of the indoor unit which is to heat the room is controlled so as to be opened fully to pass the refrigerant, and the indoor electronic expansion valve of the indoor unit which is to cool the room is controlled to cause expansion of the refrigerant.

19. A method for controlling a multi-unit air conditioner comprising the steps of:

(a) condensing a portion of gas refrigerant from a compressor at an outdoor heat exchanger, making the other portion to flow through a bypass pipeline in a gas state, and joining the condensed refrigerant and the gas refrigerant;

(b) measuring a temperature of the joined gas/liquid mixed refrigerant;

(c) detecting the gas/liquid mixing ratio from the measured refrigerant temperature; and (d) controlling a flow rate of the gas refrigerant such that a detected mixing ratio meets a preset mixing ratio required for a required operation mode.

20. The method as claimed in claim 19, wherein the step (c) includes the step of comparing a preset data on refrigerant mixing ratios versus refrigerant temperatures and the measured temperature, to detect the mixing ratio of the refrigerant.

21. The method as claimed in claim 19, wherein the step (d) includes the step of controlling an opening of the flow rate control valve on the bypass pipeline for controlling a flow rate of the gas refrigerant flowing through the bypass pipeline.

* * * * *